United States Patent [19]

Pierce, Jr.

[11] Patent Number: 4,756,026

[45] Date of Patent: Jul. 12, 1988

[54] LIMB PROTECTOR

[76] Inventor: Alfred R. Pierce, Jr., 25 Argyle Ave., Blackwood, N.J. 08012

[21] Appl. No.: 45,892

[22] Filed: May 4, 1987

[51] Int. Cl.[4] ..... A41D 13/00

[52] U.S. Cl. ..... 2/16; 2/22; 2/24

[58] Field of Search ..... 2/16, 22, 23, 24

[56] References Cited

U.S. PATENT DOCUMENTS

| | | | |
|---|---|---|---|
| 3,465,364 | 9/1969 | Edelson | 2/22 |
| 3,533,106 | 10/1970 | Kremp | 2/22 |
| 3,585,639 | 6/1971 | Enicks | 2/22 |
| 4,001,953 | 1/1977 | Fugere et al. | 2/22 X |
| 4,150,442 | 4/1979 | Boone | 2/16 |
| 4,306,315 | 12/1981 | Castiglia | 2/22 |
| 4,669,126 | 6/1987 | Jones | 2/22 |

FOREIGN PATENT DOCUMENTS

| | | | |
|---|---|---|---|
| 2310149 | 9/1974 | Fed. Rep. of Germany | 2/22 |

*Primary Examiner*—Louis K. Rimrodt

*Attorney, Agent, or Firm*—Thomas A. Lennox

[57] ABSTRACT

Contact sport protection sleeves and pads are provided for the forearm, elbow, knee and shin of the players including at least one protection panel of flexible elastomeric polymeric foam or of rigid plastic attached to an elastomeric sleeve with two flexible elastomeric polymeric foam edge pads abutting the lengthwise edges of the protection panel with the panel and edge pads all enveloped in elastomeric fabric with stitching between the abutting of the panel and the two edge pads providing extra protection with flexibility to reduce any restriction of movement of the player.

23 Claims, 2 Drawing Sheets

LIMB PROTECTOR

BACKGROUND OF THE INVENTION

This invention involves a protection sleeve fitting over a person's limb for protection from damaging blows during the play of contact sports.

The participation in a wide variety of sporting activities, generally described as "contact sports", is essentially universal. These sports do not necessarily require intentional physical contact such as in football, wrestling, karate and like sports, but also include sports that involve incidental contact, but nevertheless substantial contact, such as soccer, hockey, basketball, volleyball, field hockey, lacrosse, baseball, and like sports. The group of contact sports that involve intentional contact require pads positioned and located on various parts of the body which receive blows from opposing players. Common football padding now includes not only the shoulder pads, hip pads and like pads that are positioned under the uniform, but now commonly includes elbow pads, forearm pads and even hand pads. The typical football player wants continuous protection from the elbow to the hand but continuous padding unduly restricts movement. Karate pads typically include shin and foot pads used primarily to protect from and deliver blows to the opponent. Wrestling pads include elbow pads and knee pads to protect the participant from damaging blows from the opponent and also from the mat. For the "incidental contact" sports, shin protectors are common to players of baseball. Elbow and knee pads are common for basketball players, particularly if they have suffered an injury to that particular limb. Of course, such limb protectors are common to essentially any sport where there might be incidental contact and the player has suffered a previous injury that requires protection.

Commerically available limb protecting devices are usually constructed of an elastic cloth covering a protection panel constructed of either a flexible resilient polymeric foam pad or a rigid polymeric plastic panel that is conformed to the surface of the limb to be protected. These panels are either flat to cover a small portion of the limb or are curved to shape around a portion of the limb surface. However, if the panel area is large enough to extend around a major portion of the limb, it becomes unduly restrictive and the player cannot enjoy the free movement required to play the sport to his full capacity. This would be particularly true if rigid plastic panels were utilized to surround the protected limb. The size of the panel for protection has to be limited in order to be marketable to a player of these sports. Where 100% effort and performance is encouraged in the participation of the sport, even a slight reduction in the capacity of the player to move is critical.

These contact sports are played not only by professional athletics and essentially full grown individuals, but also by children who are still growing to their ultimate size and strength. Needless to say, the protection pads that are necessary for the professional player are even more important for the youngster to prevent serious or possibly even crippling injury. Since the circumference of the limbs of a child is much smaller, restriction of movement by a too large protection pad is an even more serious problem.

None of the prior art devices either in the literature or in commerical usage satisfy this need to provide the combination of protection and freedom of movement nor attain the objects provided herein below.

SUMMARY OF THE INVENTION

It is an object of the present invention to provide a protection sleeve interfitting on a player's limb to provide added protection from damaging blows during the playing of a contact sport.

It is a further object of the present invention to provide a protection sleeve with a contoured fit which has a minimum effect on the movement of that limb while providing the ultimate in protection from damaging blows.

It is an additional object of the present invention to provide a protection sleeve that provides protection not only on the exposed surface of the limb to be protected, but also provides protection on both lengthwise sides of that area.

It is a further object of the present invention to provide a protection sleeve that utilizes a rigid protection panel of a size and shape to protect a particular surface of the limb, but also provide protection around the sides of that panel so that a major portion of the limb is protected without undue restriction of the movement of that limb.

It is a particular object of the present invention to provide limb protectors for the forearm, wrist, hand, elbow, knee, bicep, foot, ankle and shin of the player of contact sports providing a combination of protection with minimum effect on movement of the limb.

It is an additional object of the present invention to provide a protection sleeve which will protect not only forearm and the back of the hand of a player, but also the sides of the arm and hand without undue restriction of movement.

It is a further object of the present invention to provide a shin protecting sleeve wherein the ankle bone is protected without undue restriction of movement by the player.

This invention is a protection sleeve for the protection of a player's limb from damaging blows during the play of a contact sport wherein the protection sleeve includes at least one protection panel of a sufficient size to cover a substantial portion of the surface area of the limb to be protected. The panel has a length, a width and two ends with the lengthwise edges of the panel following along the length of the limb. The panel may be divided into multiple parts along the length of the limb and no limitation is intended to the number of panel parts used. The panel may be a rigid plastic panel, a resilient flexible foam panel, or a combination thereof. The panel may be of sufficient length to extend continuously past a joint such as an elbow or knee, and even past a wrist or ankle of the player. A covering is preferably provided to envelop the panel, such as a plastic polymer film or an elastic cloth. Two flexible elastic polymeric foam edge pads are provided, each having a length at least equal to a major portion of the length of the panel and a width. Each edge pad is positioned so that a lengthwise edge abuts a lengthwise edge of the panel and may be longer the panel. An elastic cover device including an elastic cloth covering is provided enveloping both edge pads. An elastic attachment device fixed to the elastic cover is provided to hold the panel and the pads snugly against the limb to be protected. A preferred embodiment provides that the length of each edge pad is approximately equal to the length of the panel. A preferred embodiment provides that the width of each edge pad is sufficient to extend around the limb to protect the sides of the limb. It is preferred that the panel be enveloped in an elastic cloth cover and that extensions of elastic cloth include two pieces of elastic cloth each having an elastic stretch at least transverse to the length of the pads, wherein the two pieces sandwich the pads and wherein stitching is provided attaching the two pieces together, the stitching being positioned between the abutting lengthwise edges of each pad and the panel. A preferred embodiment is where the length of panel is sufficient to extend past a joint, such as a wrist or ankle, and the panel is in two parts, one on one side of the joint and one on the other, and the pads extend the entire length of the panel from one side of the joint, past the joint, to the other side of the joint. A preferred embodiment of the sleeve is where the panel is constructed of a flexible resilient polymeric foam.

A preferred embodiment is the sleeve wherein the lengths of the panel and of the edge pads are sufficient to protect the forearm of the player. In that embodiment, it is preferred that the panel be of sufficient length to extend over the back of the player's hand and the length of edge pads are sufficient to extend past the player's wrist on both sides of the hand. In the embodiment where the panel extends continuously from the forearm, past the wrist, over the back of the hand, the use of the edge pads, continuous or not, extending the entire length, provides great protection while avoiding "buckling up" of the pads as the person bends the wrist. A further preferred embodiment provides sufficient lengths to protect the shin of the player and includes a protection panel in two pieces, both pieces comprising flexible resilient polymeric foam panels, one positioned to protect the shin bone and other positioned to protect the top of the bare foot, and wherein the edge pads are positioned inside the covering extensions along the lengthwise edges of the two pieces of the protection panel. Another preferred embodiment is the sleeve wherein the lengths of the panel and of the edge pads are sufficient to protect the elbow of the player. The lengths of the sleeve in this instance is essentially equal to that required to protect the knee of a player. This length is slightly longer than the required to protect the hand. All references to a sleeve to protect the elbow are intended to include that for the knee and hand. A preferred embodiment for the protection of the elbow includes an elastic attachment device that includes two separate elastic straps spaced apart from each other and positioned proximate to the ends of the panel with each strap connecting to the covering extensions proximate to the outside of the lengthwise edge of each edge pad away from the panel. A further preferred embodiment for use on the elbow includes the elastic attachment device including an elastic sleeve tube with a hole in the tube proximate the center of the tube. A further preferred embodiment for the elbow protection sleeve includes that each edge pad is provided with a cut-out proximate the center of each edge pad, the cut-out being a notch cut from the lengthwise edge away from the panel. A further preferred embodiment of the protection sleeve includes that the lengths of the panel and of the edge pads are sufficient to protect the shin bone below the knee of the player. A further preferred embodiment of these shin pads includes that the lengths of the edge pads are sufficient to extend downwardly over the ankle bones of the player while the length of the panel is sufficient to terminate at the top of the player's foot. An additional preferred embodiment of the shin protection sleeve includes that the bottom end of the panel be contoured to a concave shape to fit over and around the top of the player's foot.

It is observed that the combination of the elements described herein above provide substantial advantages even beyond the contoured fit as particularly demonstrated in the forearm and hand pad and the shin pad configurations. In the case of the forearm pad, it is now possible to provide protection for the back and sides of the hand in combination with protection for the back and sides of the arms with no undue restriction on movement. Likewise, it is now possible to provide protection for the ankle bones at the same time the shin bone protection is provided, again without undue restriction of movement.

DESCRIPTION OF PREFERRED EMBODIMENT

Figure 1:
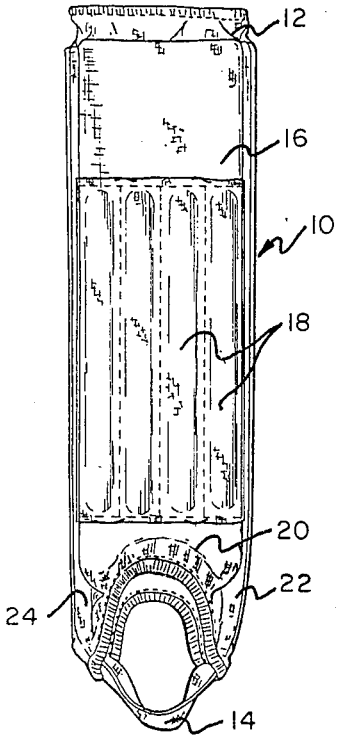
FIG. 1 is a front elevational view of a shin guard protection sleeve of the present invention.
Figure 2:
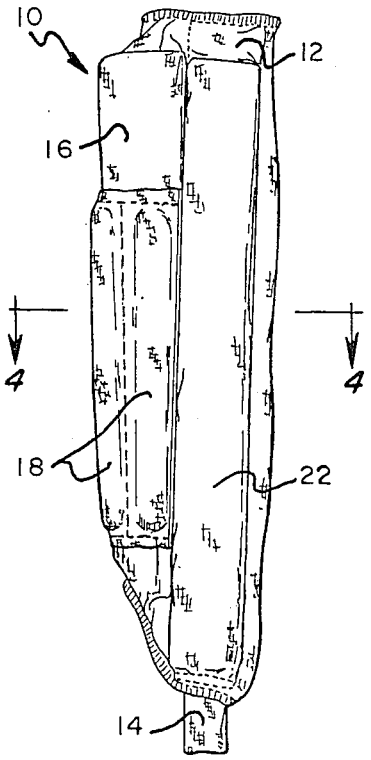
FIG. 2 is a side elevational view of the sleeve illustrated in FIG. 1.
Figure 3:
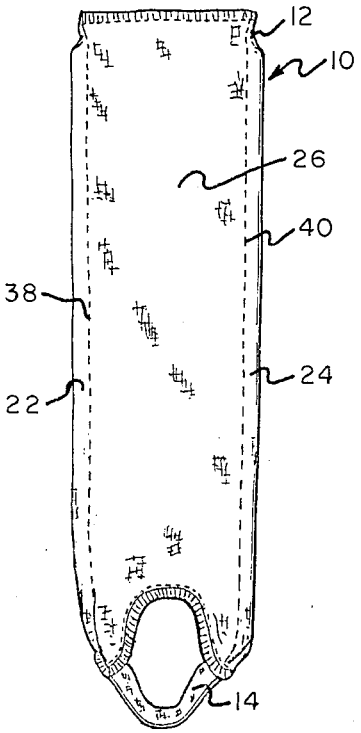
FIG. 3 is a rear elevational view of the sleeve illustrated in FIG. 1.
Figure 4:
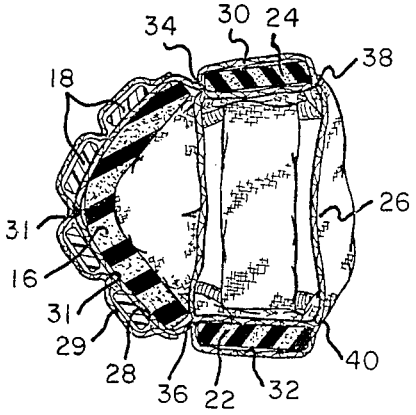
FIG. 4 is a cross-sectional view taken along lines 4—4 of FIG. 2.

In FIG. 1, shin guard 10 is constructed of an elastomeric fabric material of a nylon or nylon/polyester knitted fabric with an elastomeric fiber such as rubber, SPANDEX®, an elastomeric polymeric fiber supplied by E. I. DuPont DeNemours, or like fiber. The general construction is a sleeve of two layers of like fabric. The length of shin guard 10 is sufficient to extend from just below the knee to cover the ankle bone with strap 14 extending under the foot, inside the shoe to hold the guard in place and prevent it from riding upwardly. Sleeve top 12 extends under and in cooperation with other fabric pieces envelops protection panel 16 which is constructed of flexible elastic polymeric foam on the outside of which are fixed shin bone vertical rigid thermoplastic polymer impact strips for added impact protection. The bottom of panel 16 is contoured in a concave shape 20 to interfit over the instep of the person's foot with edge pads 22 and 24 extending downwardly below the concave shape to cover and protect the ankle bones of the wearer. As illustrated in FIG. 2, edge pad 22 (and likewise for edge pad 24 hidden in this view) is constructed of flexible elastic polymeric foam, such as foam rubber, polyurethane foam, and like products about one and one-half inches wide, preferably about one-half to three inches wide, extending downwardly over the ankle bone to protect the foot. In FIG. 3, elastic fabric attachment sleeve 26 is stitchably attached to the covering of edge pads 22 and 24 to hold panel 16 and the pads snugly to the leg. An alternate elastic attachment device is two or more straps similar to strap 14 connecting to coverings 30 and 32, one proximate the top and another proximate the bottom of panel 26. The cross-sectional view of FIG. 4 illustrates the internal construction of protection sleeve 10. Elastic cloth covering 28 extends over protection panel 16 and is extended to cover and envelop pads 22 and 24 with extensions 30 and 32. Outside cover 29 is attached by stitching 31 enveloping strips 18 and holding them in place. Stitching may be replaced by adhesive or preferably hook and loop detachable attachment strips. Elastic attachment sleeve 26 extends behind pads 22 and 24 and behind panel 16 forming an elastic sleeve which snugly fits over the limb to be protected. Stitching line 34 extends between the edge of panel 16 and the abutting edge of pad 24 between cover 28 and cover 30, both attaching to sleeve 26. Likewise stitching line 36 runs between the edge of panel 28 and the abutting edge of edge pad 22 attaching outside cover 28 and cover 32 to sleeve 26. Stitch lines 38 and 40 run along the outside edges of pads 22 and 24 holding those pads in place and enveloping them between the two layers of fabric. While sleeve top 12 and sleeve 26 effectively hold shin guard 10 in place, an alternative attachment device is a non-elastic strap proximate to the top of shin guard IO may be used. The non-elastic strap is sewn at one end to the top and is pulled around the person's leg with the end attached with hook and eye fastener to the guard. The elastic sleeve 26 is not required at the top, but is typically used at the bottom of the guard to attach to and hold to the leg.

Figure 5:
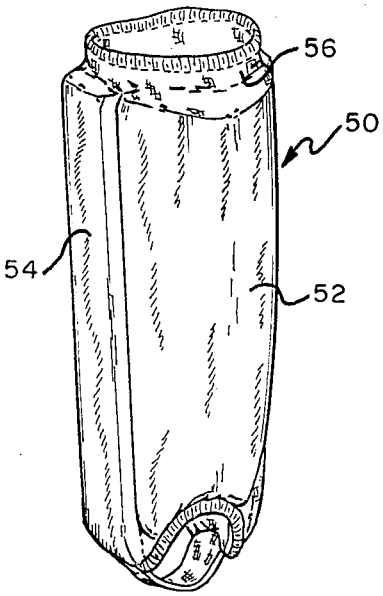
FIG. 5 is a perspective view of a second shin protection sleeve of the present invention.
Figure 6:
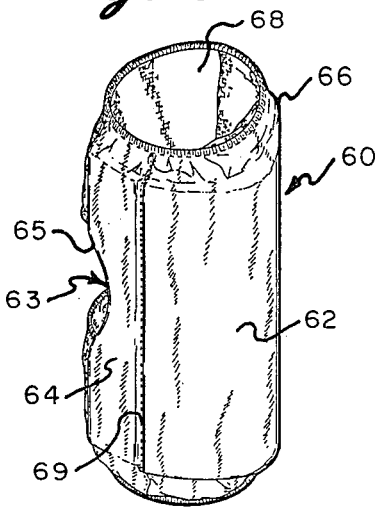
FIG. 6 is a perspective view of an elbow, knee or hand protection sleeve of the present invention.
Figure 7:
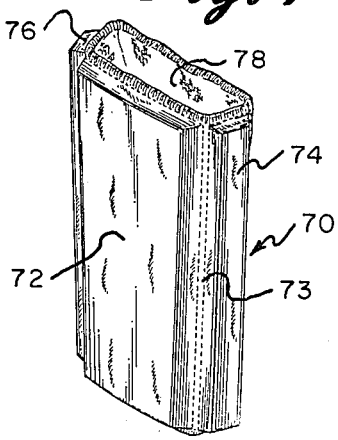
FIG. 7 is a perspective view of a forearm protection sleeve of the present invention.
Figure 8:
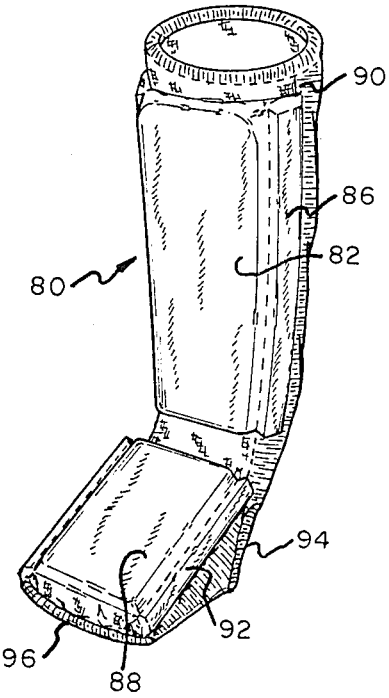
FIG. 8 is a perspective view of a shin and foot protection sleeve of the present invention.
Figure 9:
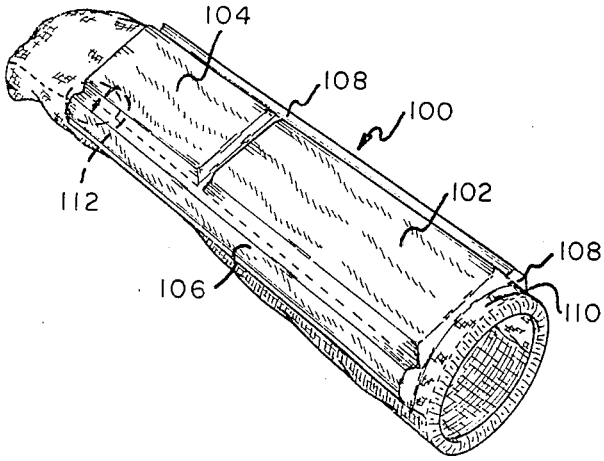
FIG. 9 is a perspective view of a second embodiment of a forearm and hand protection sleeve of the present invention.

In FIG. 5, shin guard protection sleeve 50 is constructed of resilient foam panel 50 and side edge pads 54 (one on opposite side is hidden in this view) enveloped and stitchably attached to elastic sleeve 56. In FIG. 6, elbow or knee protection pad 60 is constructed of resilient flexible polymeric foam pad 62 and edge pads 64 and 66 (mostly hidden in this view) all stitchably attached together to elastomeric sleeve 68. Stitching 69 separates edge pads 64 from protection panel 62 facilitating flexibility and movement between the two pads. Cut out 65 is cut from the edge of edge pad 64 furthest away from anel 62. A similar notched edge cut out is removed from edge pad 66 (hidden in this view). Hole 63 is cut out of elastomeric sleeve 68, which, together with notch cut-out 65 and the notch cut out of edge pad 66, all facilitate movement of the arm at the elbow while retaining the positioning of protection pad 60. In FIG. 7, forearm protection pad 70 is constructed of elastomeric foam panel 72 and edge pads 74 and 76 constructed in a fashion similar to that of sleeve 10 to elastomeric sleeve 78. Preferred double stitching 73 separates abutting edges of pad 74 with the lengthwise edge of panel 72 and a similar double stitching separates the abutting edges of edge pad 76 and panel 72 to facilitate flexibility and movement while wearing the device. In FIG. 8, karate training pad 80 covers the shin bone and the top of the foot of the wearer. Protection device 80 includes a panel composed of upper panel 82 which protects the shin bone and lower panel 88 which protects the top of the foot. Both of these pads are attached with fabric covering and stitching to sleeve 90 which snugly interfits over the lower leg and foot. Sleeve extension 92 extends over the foot and provides heel opening 94 and toe opening 96 which allows the toes to extend outwardly at the end of the sleeve. Edge pads 86 and 88 (hidden) extending from below the knee to the ankle are held by the cover along the lengthwise edge of panel providing protection to the sides of the leg, with excellent mobility. In FIG. 9, football forearm and hand protection device 100 is shown with the foam panel provided in two parts, forearm panel 102 and back of hand panel 104. Edge pads 106 and 105 (partially hidden) extend end to end unbroken from below the elbow to the knuckles. Sleeve 110 is a double layer of elastic fabric enveloping and sandwiching the panel and the edge pads with stitching separating all abutting edges. A double line of stitching is preferred between the edge pads and the panel. Thumb hole 112 is shown in hidden lines to allow minimum restriction of movement. The edge pads provide the ultimate in protection with minimum restriction. The side pads may be broken into pieces along the length, but it is not necessary.

While this invention has been described with reference to the specific embodiments disclosed herein, it is not confined to the details set forth and the patent is intended to include modifications and changes which may come within and extend from the following claims.

I claim:

1. A protection sleeve for the protection of a player's limb from damaging blows during the play of a contact sport, the protection sleeve comprising:

(a) at least one protection panel of a sufficient size to cover a substantial portion of the surface area of the limb to be protected, the panel having a length, a width, and two ends, with lengthwise edges following along the length of the limb, (b) two flexible elastic polymeric foam edge pads, each having a length at least equal to a portion of the length of the panel and a width, each edge pad positioned so that a lewngthwise edge abuts a lengthwise edge of the panel, (c) elastic cover means comprising an elastic cloth cover, enveloping both edge pads, each comprising an inside piece of elastic cloth and an outside piece of elastic cloth, each piece having elastic stretch at least transverse to the length of the pads and wherein the cover is attached to the protection panel, (d) at least one line of stitching attaching the two pieces of elastic cloth together, the stitching running between the abutting lengthwise edges of each pad and the panel, and (e) an elastic attachment means fixed to the elastic cover means to hold the panel and the pads snugly against the limb to be protected, wherein attachment of the elastic cover means to the elastic attachment means holds the foam edge pads in abutment with the elastic attachment means.

2. The protection sleeve of claim 1 wherein the length of each edge pad is equal to the length of the panel.

3. The protection sleeve of claim 1 wherein the width of each edge pad is sufficient to extend around the limb to protect sides of the limb.

4. The protection sleeve of claim 1 wherein the panel comprises at least one rigid polymeric plastic panel.

5. The protection sleeve of claim 4 wherein the protection panel further comprises at least one rigid polymeric plastic plate fixed to an outer face of the protection panel.

6. The protection sleeve of claim 1 wherein the panel is of flexible resilient polymer foam.

7. The protection sleeve of claim 1 wherein the elastic attachment means comprises an elastic cloth cover enveloping the panel.

8. The protection sleeve of claim 1 wherein the elastic attachment means comprises an elastic sleeve stitched to form the inside piece of the cloth covering enveloping the edge pads.

9. The protection sleeve of claim 1 wherein the lengths of the panel and of the edge pads are sufficient to extend past the players joint, the panel being broken into two parts along the length of the limb being protected, and the edge pads are unbroken lengths.

10. The protection sleeve of claim 1 wherein the lengths of the panel and of the edge pads are sufficient to protect the forearm of the player.

11. The protection sleeve of claim 10 wherein the panel is of sufficient length to extend over the back of the player's hand and the length of the edge pads are sufficient to extend on both sides of the player's hand.

12. The protection sleeve of claim 11 wherein the length of the edge pads is sufficient to extend to the wrist of the player's hand.

13. The protection sleeve of claim 1 wherein the lengths of the panel and of the edge pads are sufficient to protect the elbow of the player.

14. The protection sleeve of claim 13 wherein the elastic attachment means comprises two separate elastic straps spaced apart from each other and positioned proximate the ends of the panel, with each strap connecting to the cloth cover proximate the outside lengthwise edge of each edge pad away from the panel.

15. The protection sleeve of claim 13 wherein the elastic attachment means comprises an elastic sleeve tube with a hole in the tube proximate the center of the tube.

16. The protection sleeve of claim 13 wherein each edge pad is provided with a cut-out proximate the center of each edge pad, the cut-out being a notch cut from the lengthwise edge away from the panel.

17. The protection sleeve of claim 1 wherein the lengths of the panel and of the edge pads are sufficient to protect the lower leg below the knee of player.

18. The protection sleeve of claim 17 wherein the lengths of the edge pads are sufficient to extend downwardly over the ankle bone of the player while the length of panel is sufficient to terminate at the top of the player's foot.

19. The protection sleeve of claim 18 wherein the bottom end of the panel is contoured to a concave shape to fit over and around the top of the player's foot.

20. A protection sleeve for the protection of a player's limb from damaging blows during the play of a contact sport, the protection sleeve comprising:

(a) at least one protection panel of a sufficient size to cover a substantial size to cover a substantial portion of the surface area of the limb to be protected, the panel having a length, a width, and two ends, with lengthwise edges following along the length of the limb, (b) an elastic cloth cover enveloping the panel, (c) two flexible elastic polymeric foam edge pads, each having a length at least equal to a portion of the length of the panel and a width, each edge pad positioned so that a lengthwise edge abuts a lengthwise edge of the panel, (d) extensions of the elastic cloth cover, enveloping both edge pads each comprising two pieces of elastic cloth each having elastic stretch at least transverse to the length of the pads and the two piece sandwiching the pads, (e) at least one line of stitching the two pieces of elastic cloth together, the stitching running between the abutting lengthwise edges of each pad and the panel, and (f) an elastic attachment means fixed to the elastic cover means to hold the panel and the pads snugly against the limb to be protected.

21. The protection sleeve of claim 20 wherein the elastic attachment means comprises an elastic sleeve stitched to form an inside piece of the cloth covering enveloping the edge pads.

22. The protection sleeve of claim 20 wherein the lengths of the panel and of the edge pads are sufficient to extend past the players joint, the panel being broken into two parts along the length of limb being protected, and the edge pads are unbroken lengths.

23. The protection sleeve of claim 20 wherein the lengths of the edge pads are sufficient to extend downwardly over the ankle bone of the player while the length of panel is sufficient to terminate at the top of the player's foot.

* * * * *